US008398822B2

(12) United States Patent
Mennucci et al.

(10) Patent No.: US 8,398,822 B2
(45) Date of Patent: Mar. 19, 2013

(54) THERMALLY INSULATED YANKEE CYLINDER

(75) Inventors: Giovan Battista Mennucci, Stefano di Moriano (IT); Francesco Simoncini, Lucca (IT); Paolo Raffaelli, Lucca (IT); Simone Pieruccini, Lucca (IT)

(73) Assignee: Toscotec S.p.A., Marlia (IT)

( * ) Notice: Subject to any disclaimer, the term of this patent is extended or adjusted under 35 U.S.C. 154(b) by 0 days.

(21) Appl. No.: 13/394,996

(22) PCT Filed: Sep. 2, 2010

(86) PCT No.: PCT/IT2010/000383

§ 371 (c)(1), (2), (4) Date: Mar. 8, 2012

(87) PCT Pub. No.: WO2011/030363

PCT Pub. Date: Mar. 17, 2011

(65) Prior Publication Data

US 2012/0168106 A1 Jul. 5, 2012

(51) Int. Cl.
*D21F 1/60* (2006.01)

(52) U.S. Cl. ..... 162/357

(58) Field of Classification Search ..... 162/357; 34/110, 119, 289
See application file for complete search history.

(56) References Cited

U.S. PATENT DOCUMENTS

| | | | |
|---|---|---|---|
| 2,367,578 | A | 1/1945 | Helin |
| 3,116,985 | A | 1/1964 | Kraus |
| 3,224,084 | A | 12/1965 | Johnson |
| 3,911,595 | A | 10/1975 | Lande |
| 3,914,875 | A | 10/1975 | Schiel |
| 4,320,582 | A | 3/1982 | Klippstein et al. |
| 4,520,578 | A | 6/1985 | Schiel et al. |
| 4,878,299 | A | 11/1989 | Wedel |

FOREIGN PATENT DOCUMENTS

| | | | |
|---|---|---|---|
| GB | 685 009 | | 12/1952 |
| GB | 839 159 | A | 6/1960 |
| WO | 83/01676 | A1 | 5/1983 |
| WO | 2006/057023 | A1 | 6/2006 |
| WO | 2008/105005 | A1 | 9/2008 |

*Primary Examiner* — Mark Halpern
(74) *Attorney, Agent, or Firm* — McGlew and Tuttle, P.C.

(57) ABSTRACT

The Yankee cylinder (1) for drying webs of cellulose material comprises a cylindrical shell (3) with a substantially cylindrical outer surface, whereto end heads (5) are fixed by welding; the shell and the heads define a hollow inside volume of the cylinder and the heads have respective support journals (7). An insulation (17) of the end heads is further provided.

31 Claims, 4 Drawing Sheets

1
5
5A
17
7
21
25
II
II
4
3

THERMALLY INSULATED YANKEE CYLINDER

This application is a 371 of PCT/IT2010/000383 filed 2 Sep. 2010.

TECHNICAL FIELD

The present invention relates to improvements to the so-called Yankee cylinders used in paper manufacturing industry.

PRIOR ART

According to the most traditional techniques, paper is produced starting from an aqueous slurry of cellulose fibers and possible further additives, with a very low dry content, in the order of fractions of percentage points by weight. The mixture is fed by a headbox on a forming wire and through subsequent transfer steps between wires and felts, with the use of suction systems, the water amount in the layer of slurry is gradually reduced to obtain a web or layer of cellulose fiber with a water content sufficiently low to have a consistency that allows the web to be made to pass in a drying system. In some paper manufacturing machines, the drying system comprises a Yankee cylinder, that is, an internally hollow cylinder, wherein a thermal carrier fluid is made to circulate, typically steam. The paper web is dried, that is, its water content is reduced, through evaporation at the expense of the heat yielded by the Yankee cylinder through its outer wall wherealong the paper material web is guided.

Examples of Yankee cylinders are described U.S. Pat. No. 3,224,084; U.S. Pat. No. 3,116,985; U.S. Pat. No. 3,911,595; U.S. Pat. No. 3,914,875; U.S. Pat. No. 4,320,582; GB-685,009.

Traditionally, Yankee cylinders were made of cast iron. More recently, steel Yankee cylinders have been introduced, as described for example in WO-A-2006/057023; WO-A-2008/105005.

Steel Yankee cylinders are normally made by welding and comprise an outer cylindrical surface formed by a cylindrical shell, at the ends whereof the heads are fixed. The connection is usually made by welding. The heads externally carry the cylinder support journals. The hollow inside volume of the Yankee cylinder is defined between heads and shell, wherein the steam is introduced for heating the outer surface of the Yankee cylinder.

In steel Yankee cylinders, the heads are generally flat unlike what usually happens in cast-iron Yankee cylinders, where vice versa the heads have a curved shape, with a concavity facing outwards.

The steam introduced in the Yankee cylinder must yield heat to the paper web through the cylindrical surface. The heat dispersed through the head surface is a lost energy share. U.S. Pat. No. 4,520,578 describes a cast-iron Yankee cylinder with concave-shaped heads, fitted with an insulating system having the function of reducing the amount of heat dispersed through the heads.

SUMMARY OF THE INVENTION

The object of the present invention is to provide a Yankee cylinder, in particular a steel Yankee cylinder, with an efficient head insulation system.

Substantially, in one embodiment, the invention provides a Yankee cylinder for drying webs of cellulose material, comprising a cylindrical shell with a substantially cylindrical outer surface, whereto end heads are fixed, preferably by welding, said shell and said heads defining a hollow inside volume of the cylinder, the heads having respective support journals, and comprising an insulation of the end heads. According to preferred embodiments the insulation provided on each end head is connected to the end head such as to rigidly rotate integrally with the Yankee cylinder. Connection between an insulation shield and the end head can be provided by means of an annular connection ring. In some embodiments the annular connection ring projects from a generally planar outer surface of the respective end head. Preferably the annular connection ring has an outer cylindrical surface which is flush with the outer cylindrical surface of the shell and with the outer cylindrical edges of the end heads. The entire side surfaces of the Yankee cylinder will then be thermally insulated. A respective journal is connected, by screwing or preferably by welding, to the end head and projects therefrom and is preferably centered with respect to the annular connection ring. In some embodiments the insulation shield is restrained to the respective journal as well as to the connection ring. Preferably, the connection ring has an outer cylindrical surface which forms an extension of the outer cylindrical surface of the shell. A welding bead can be provided, extending up to the cylindrical surface. A continuous surface treatment, extending on the cylindrical surface of the shell, the cylindrical surfaces of the end heads and the outer cylindrical surfaces of the connection rings can be provided, such that a continuous treated cylindrical surface is obtained, on which the paper web can be guided and around which it can be entrained. In preferred embodiments the heads and the shell are welded together and corresponding welding beads surfaces on the cylindrical surface of the cylinder.

Preferably the end heads of the Yankee cylinder are free of holes drilled therein for the purpose of connecting an insulation shield thereto, such that a higher reliability in terms of mechanical strength is achieved. This is most important considering that the shell and the end heads of the Yankee cylinder are subject to high dynamical stresses.

According to some preferred embodiments of the invention, a connecting ring fixed to each head is provided, which has a substantially cylindrical outer surface, whereon a substantially continuous annular welding bead surfaces, for jointing the connecting ring to the respective head, said ring being preferably provided with threaded holes for anchoring the insulation.

According to preferred embodiments of the invention, an insulation connecting ring, surrounding the respective journal and arranged spaced therefrom, is fixed on each of said heads. The connecting ring fixing is advantageously obtained by welding.

In some preferred embodiments of the invention, the insulation connecting ring has a cylindrical side surface flush with and constituting a continuation of, the outer cylindrical surface of the Yankee cylinder shell.

In some embodiments, the insulation comprises a plurality of segments or sectors adjacent to each other, each constrained to the respective connecting ring and to the respective journal. Each insulation segment or sector may be made of an insulating sheet. The radial edges of consecutive segments or sectors are preferably overlapped for obtaining greater stability in fixing said segments so as to improve the mechanical reliability.

According to preferred embodiments of the invention, each segment or sector comprises an insulating sheet, preferably fitted with a layer of thermally insulating material, fixed to the connecting ring by screw means in the proximity of a radially outer edge, and constrained by a radially internal edge thereof to the respective journal, for example inserting the radially internal edge of the sheet into an annular slot or groove of the journal. The depth of this groove is preferably oversized for allowing a radial relative motion between the insulating sheets and the groove side surfaces. In operating conditions, in fact, the Yankee cylinder reaches a higher temperature than the insulating sheets. Since such sheets are stiffly connected to the radially external periphery of the Yankee cylinder and since such sheets are at a lower temperature, the Yankee cylinder expansion causes a movement of the sheet outwards of the groove, that is, it tends to go out. To prevent the sheet from completely going out of the groove (the constraint in axial direction relative to the Yankee cylinder would thus be lost), it must sink into the groove by a certainly larger depth than the maximum difference between the expected expansions.

According to particularly advantageous embodiments of the invention, the connecting ring has a substantially cylindrical outer surface, constituting an extension of the substantially cylindrical outer surface of the shell.

Preferably, the connecting ring is welded to the respective head by means of a substantially continuous annular welding bead. This welding bead is preferably positioned at the radially outer edge of the head, said connecting ring having an outside diameter equal to the outside diameter of the Yankee cylinder shell. Preferably, the welding bead is made so as to surface on a radially outer surface of said connecting ring and on a radially inner surface of said connecting ring. To this end, according to advantageous embodiments of the invention, a substantially annular continuous slot or groove is formed between the connecting ring and the head on the radially inner side of the connecting ring. The provision of such groove allows obtaining two advantages:

1) making the welding made on the radially outer surface come to the surface. A fully penetrating welding is thus obtained, characterized in that the surfaces coming to surface both in radially outer direction and in radially inner direction are processed by machine tool, and therefore they have a better surface finish that ensures greater resistance of the welded joint against the fatiguing stresses;
2) the making of the slot allows obtaining such a shape of the ring cross section as to insulate the zone wherein the blind threaded holes for fixing the insulating sheets through screws are made. This is useful since such holes represent weakening zones and notches capable of concentrating the stresses. The weakening obtained through the groove turning allows limiting the stress at such holes. Moreover, a possible splitting triggered by fatigue at the hole vertex may only propagate up to the inner wall of the groove, thereby without affecting the Yankee cylinder head. In this respect, the groove further increases the reliability of the insulated Yankee cylinder.

Preferably the shell, the heads and the connecting rings are made of steel and each head has a substantially flat outer surface.

Further advantageous features and embodiments of the cylinder according to the invention and of the method for the manufacture thereof are described hereinafter with reference to some embodiments, and in the appended claims which form an integral part of the present description.

BRIEF DESCRIPTION OF THE DRAWINGS

The invention will be better understood by following the description and accompanying drawing, which shows practical non-limiting embodiments of the invention. More specifically, in the drawing.

DETAILED DESCRIPTION OF EMBODIMENTS OF THE INVENTION

Figure 1:
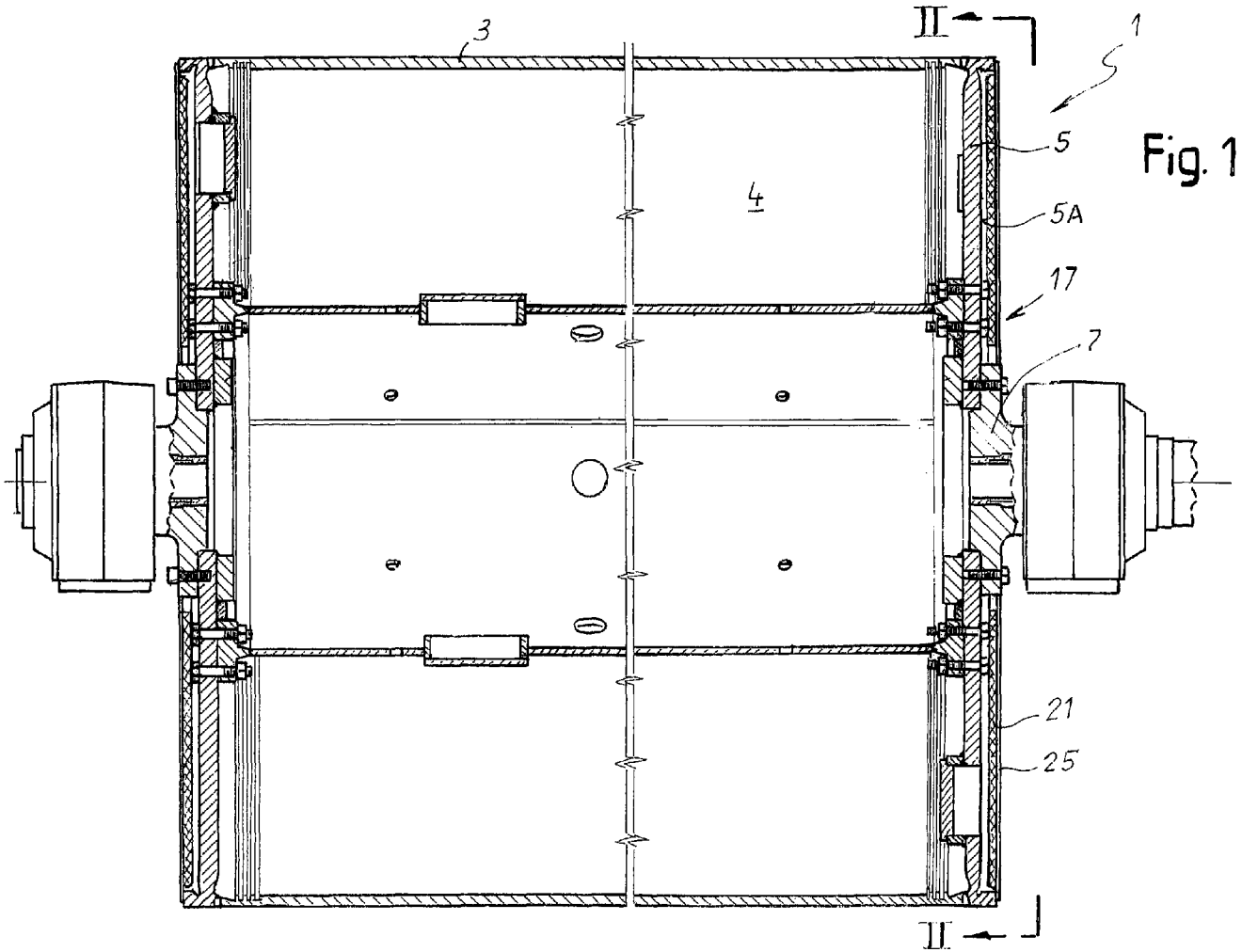
FIG. 1 shows a longitudinal section of a Yankee cylinder.

FIG. 1 shows a steel Yankee cylinder indicated with reference numeral 1 as a whole. The Yankee cylinder comprises a shell 3 and end heads 5, typically fixed by welding to shell 3. The heads and shell 5, 3 define a hollow inside volume 4, wherein steam or other thermal carrier fluid is introduced, which yields heat through the cylindrical surface of shell 3. The heat carrier fluid flows into and through the hollow volume 4 such that heat is directly transferred from the fluid to the inner surface of the shell and through said shell to the paper web guided around the outer cylindrical surface of the Yankee cylinder 1. Annularly shaped condensate collection grooves can be provided on the inner surface of the shell, see FIGS. 4A, 4B.

Since the Yankee cylinder 1 is preferably made of steel, starting from a flat sheet processed and welded, rather than by casting, the heads 5 have a substantially flat development or are made from portions of flat sheet welded to one another. The general structure of a steel Yankee cylinder of this type and possible welding techniques and systems for obtaining it are described in WO-A-2008/105005, the contents whereof are incorporated in the present description.

The support journals 7 of the Yankee cylinder are fixed outside heads 5, through welding and/or by means of screws.

Figure 2:
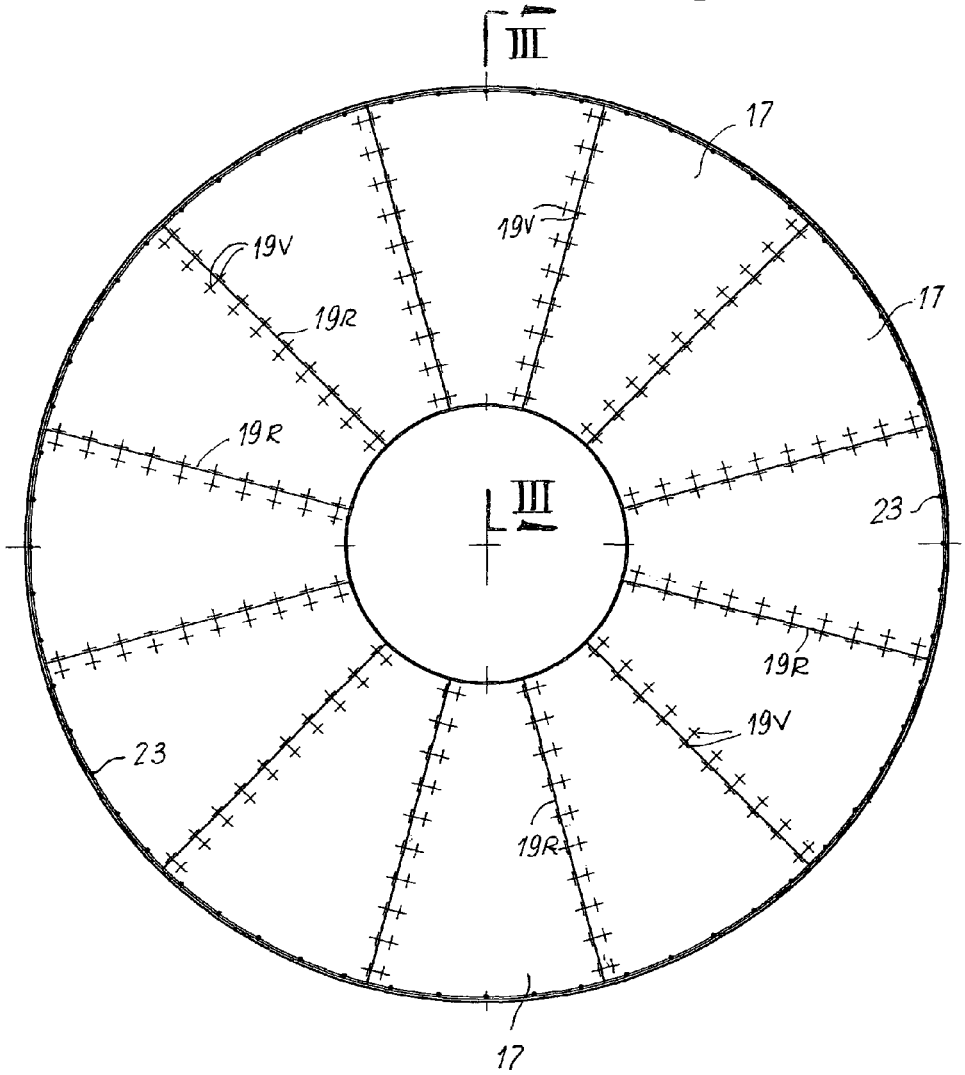
FIG. 2 shows a front view according to II-II of FIG. 1.
Figure 3:
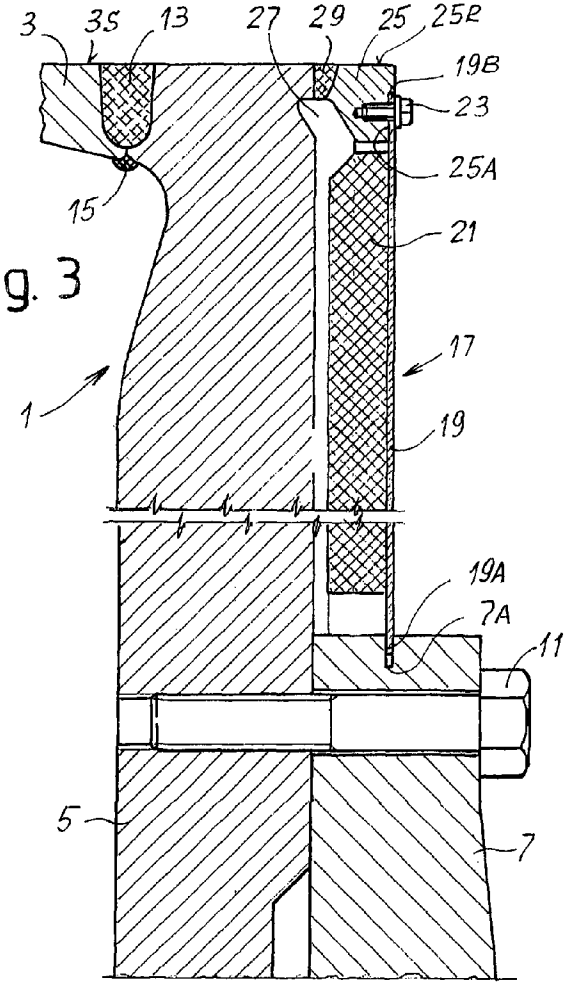
FIG. 3 shows a section view according to of FIG. 2.

FIG. 2 shows a front view according to II-II of FIG. 1 and FIG. 3 shows a section according to III-III of FIG. 2. This section shows in greater detail the connecting zone between a head 5 and the cylindrical shell 3 of the Yankee cylinder 1, as well as the journal 7 fixed to the respective head 5. In this embodiment, the connection between the journal and head 5 is obtained by a series of screws 11. Head 5 is fixed along the respective edge of shell 3 through two welding beads 13 and 15, which may be made for example as described in WO-A-2008/105005, to which reference shall be made for more details.

An insulation, globally indicated with reference numeral 15, is fixed on the outer surface of head 5. This insulation is formed by single segments 17, see in particular FIG. 2, each of which comprises an insulating sheet 19 insulated by a layer of insulating material 21, for example glass wool, rock wool. In some embodiments it is possible to provide a simple sheet 19 without a further insulating layer, since a certain degree of thermal insulation may also be obtained simply by the effect of the presence of a volume or layer of air which is still with respect to the Yankee cylinder head, between said head and sheet 19, thus reducing the heat dispersion by forced convection due to the rotating motion of the cylinder. Each sheet or sheet segment 19 has a radially innermost edge 19A, protruding with respect to the insulating layer 21 radially inwards, i.e. towards axis A-A of the Yankee cylinder, so as to insert into an annular groove 7A made on the external flange of journal 7. This groove 7A has a greater depth than that required for seating edge 19A of the sheet segment 19 when the Yankee cylinder is cold, so as to allow a thermal expansion of the head without losing the constraint between journal 7 and the radially inner edge of sheet 19, the radially outermost edge whereof is fixed through screws 23 to a connecting ring 25 between insulation 15 and the Yankee cylinder 1.

As shown in particulars in the detail of FIG. 3, the connecting ring 25 has a lowered annular seat 25A formed on the outside front surface of the same ring 25. This seat houses the outer edges 19B of the various sheets or sheet segments 19, which are fixed into the seat through the above screws 23.

In cross section, the connecting ring 25 has a variable thickness so as to form a continuous annular slot 27 between the connecting ring 25 and the outer surface of the respective head 5.

The connecting ring 25 is fixed to the outer surface of head 5 through a welding bead 29 which surfaces on both the outer cylindrical surface of the Yankee cylinder 1 and on the inner surface of slot 27, so as to be inspected by ultrasound or X-ray systems. This welding bead allows obtaining a fully penetrating weld with the surfaces coming to surface machined so as to eliminate notches and obtain a better surface finish. A higher structural reliability is thus obtained, especially in terms of fatigue resistance.

Slot 27 has such shape as to also affect a part of the thickness of head 5, that is, the substantially annular slot 27 penetrates into the thickness of head 5 by a gradually increasing extent from an innermost radial position towards an outermost radial position so as to form a substantially conical surface obtained by machining starting from the flat surface of head 5, according to a process described hereinafter. Such slot is obtained by chip removal, through turning, for regaining the welding bead from the radially inner portion of the ring. The reason why there occurs a penetration into the head is that it is only nominally flat: actually, due to the production processes of both the sheet and the Yankee cylinder as a whole, there are planarity errors in head 5. Since slot 27 is made by turning, the only way for totally regaining the welding from inside the ring is to provide a "breaking down" of the tool inside the nominal plane.

As an alternative, in order to limit the breaking down depth inside the head and to facilitate the manufacturing process, it is possible to make a leveling on the head before welding the ring. Such leveling shall totally regain a plane. The ring may later be welded directly onto such plane. In this way, the groove shall have to sink into the head only by the extent required to regain the inner surface of the welding, without having to compensate any planarity errors.

In the preferred embodiment shown in FIG. 3, the connecting ring 25 is welded in the outermost position of the respective head 5, so as to form with its outer radial surface 25R a continuation of the cylindrical surface 3S of shell 3. In this way, on the one hand the advantage of a surface continuity of the cylindrical shell 3 is obtained. The Yankee cylinder 1 is thus provided with a cylindrical outer surface formed by the flushing outer cylindrical surfaces of the shell 3, the two end heads 5 and the two connecting rings 25. On the other hand the advantage is achieved of providing the welding bead 29 that connects the connecting ring 25 to head 5 as far as possible from the welding beads 13 and 15 that connect the respective head 5 to shell 3. This allows achieving an important advantage in terms of mechanical stresses of the Yankee cylinder 5, since welding 29 is made in the point which is farthermost distanced from the force lines induced by the bending stresses in the welding zone 13, 15.

Figure 4A:
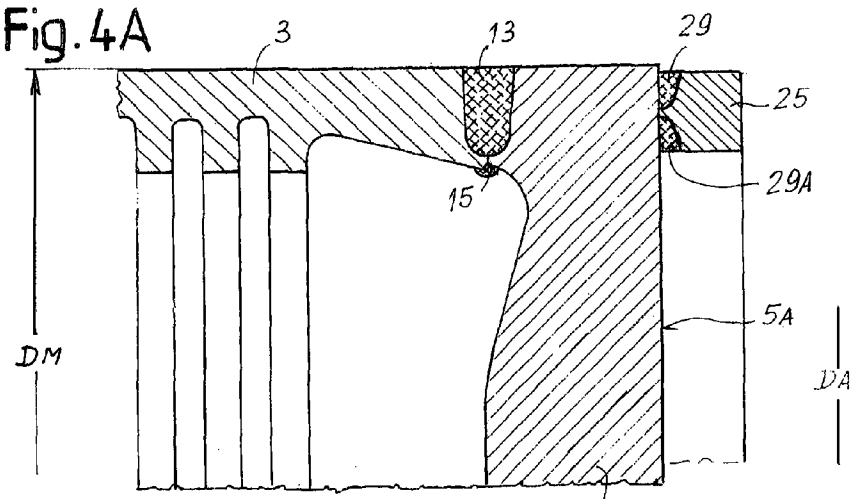
FIGS. 4A and 4B show an enlargement of a head portion showing the process for providing the systems for fixing the insulation to the head.
Figure 4B:
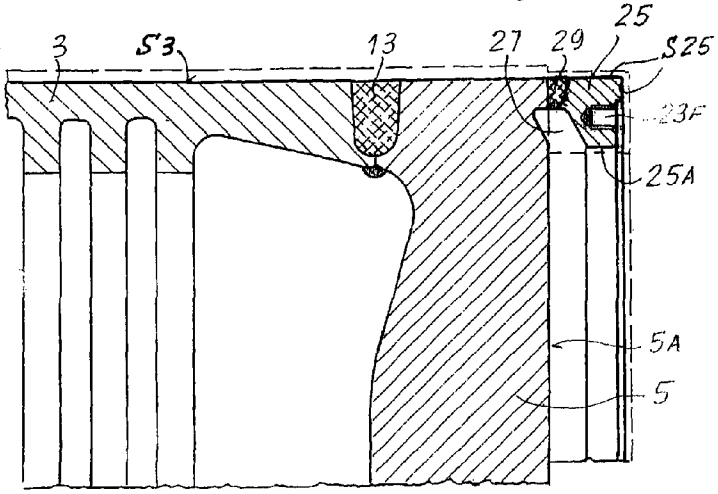

FIGS. 4A and 4B show a possible processing sequence for fixing the connecting ring 25 to head 5 of the Yankee cylinder 1. In a first processing step, the connecting ring 25, which may be obtained by calendering from a flat sheet, is welded with a dual outer 29 and inner 29A welding bead on the outer flat face 5A of head 5. The starting diameter DA of the connecting ring 25 is slightly less than the starting diameter DM of shell 3, so that the outer surface of the latter protrudes radially relative to the outer surface of the connecting ring 25.

In a subsequent mechanical lathe processing, a layer of material or stock S3 is removed from shell 3 and a layer or stock S25 is removed from the connecting ring 25. The stock layer S25 is removed not only from the outer cylindrical surface of ring 25, but also from its flat front surface up to form the lowered seat 25A. The thickness of material S3 and S25 removed from the outer cylindrical surface is such as to form a continuous cylindrical surface, so that the outer cylindrical surface of the connecting ring 25 becomes a continuation of the outer cylindrical surface of shell 3, as described above.

In this step, also slot 27 is machined by chip removal with a suitable tool that penetrates between the outer flat surface 5A of the head and the inner cylindrical surface of ring 25, integrally removing the inner welding bead 29A, penetrating into the material of ring 25 and of head 5 up to bringing to surface the innermost part of the welding bead 29, so that it is accessible from the exterior and from the interior for the above quality checks and the ultrasound or X-ray controls and allowing obtaining such shape as to ensure the structural advantages mentioned above, thanks to the elimination of surface irregularities, which may be trigger points of fatigue breakage.

After these manufacturing steps, along the development of the connecting ring 25 the threaded holes are made for screws 23 for fixing the insulating panels or segments 17. In this way, the threaded holes, indicated with 23F in FIG. 4B, for fixing the insulating panels or segments 17 are made in the connecting ring 25, rather than in the thickness of head 5, preventing weakening of the latter. Sheets 19 of each insulating panel or segment 17 have radial edges 19R (FIG. 2) that partially overlap so as to form a complete covering of the radially outer surface of head 5 with respect to the relative journal 7. Reference numeral 19V indicates screws connecting sheet segments 19 one to the other.

FIGS. 5A to 5F show less advantageous embodiments of an insulating system according to the invention. The same numbers indicate parts which are the same as or similar to those described above.

Figure 5:
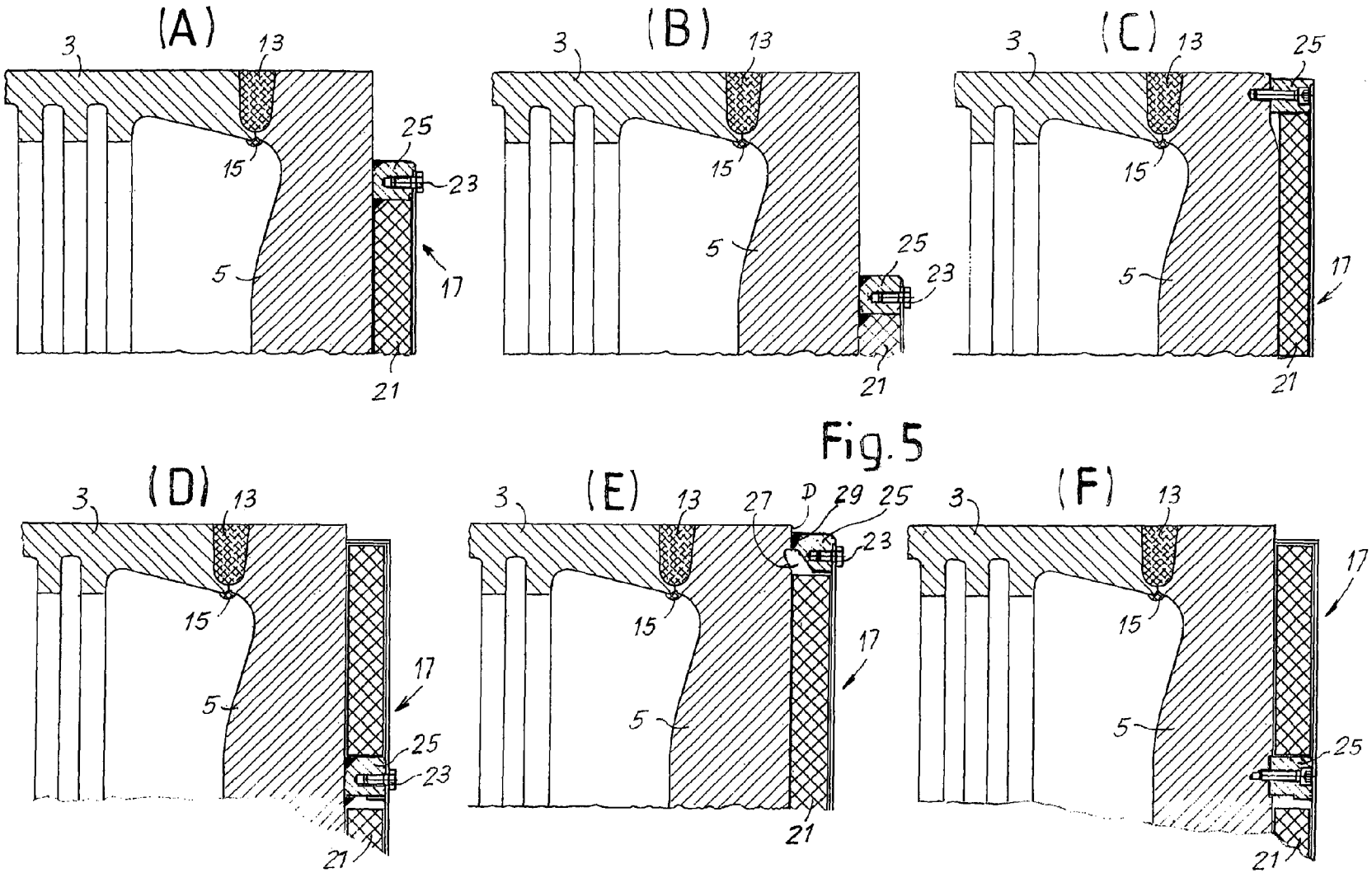
FIGS. 5A to 5F are figures similar to FIG. 4B, wherein modified embodiments are shown.

In particular, in FIG. 5A the fixing ring 25 is welded with a dual welding bead in a position which is radially retracted with respect to the outer cylindrical surface of shell 3, which implies a lower advantage both in terms of possibility of inspecting the welding bead between connecting ring and head, and in terms of distancing of the welding bead between connecting ring and head from the force lines generated by the stresses between shell 3 and head 5. Moreover, stiffer notches are provided.

FIG. 5B shows a version of the embodiment of FIG. 5A, wherein the radial development of the insulation is even less, and the connecting ring 25 is welded in an innermost position, with similar drawbacks already described with reference to FIG. 5A, besides a lower insulating effect. In this case, compared to the solution FIG. 5A, the structural drawbacks are reduced since the zone with higher tensional gradient becomes farther, but to the expense of the lack of insulation in the zone with the maximum peripheral speed of the Yankee cylinder, that is, in the zone where the thermal dissipation by convection is higher. In substance, in order to improve the reliability of welding between ring and head with respect to the embodiment of FIG. 5A, the insulation efficiency is worsened.

In FIG. 5C, the connecting ring 25 is fixed by screws in a position which is radially retracted with respect to the outer cylindrical surface of shell 3, with fewer advantages in structural terms for the presence of the connecting screws between the Yankee cylinder and the connecting ring 25. This is because the blind holes of screws are potential triggering points for splitting due to fatigue.

FIG. 5D shows an embodiment similar to that of FIG. 5B, wherein however each insulating segment is extended outside the connecting ring 25, improving the insulation quality compared to FIG. 5B, but with a less safe anchoring of the insulation to the head. In fact, the portion radially protruding beyond the connecting ring 25 is constrained in a less stiff manner with respect to the centrifugal force that, at the Yankee cylinder periphery, can be considerably high.

FIG. 5E shows an embodiment similar to those of FIGS. 3 to 4B, but wherein the connecting ring 25 has a smaller radial dimension than shell 3 so as to form an annular shoulder D on the outer cylindrical surface of the Yankee cylinder.

Finally, FIG. 5F shows an embodiment similar to that of FIG. 5D, but wherein the fixing ring 25 is anchored to head 5 by a series of screws rather than by welding, with clear fewer advantages in terms of structural strength of the cylinder due to the presence of bending holes in the head.

It is understood that the description above only represents practical non-limiting embodiments of the invention, which can vary in forms and arrangements without however departing from the scope of the concept on which the invention is based. Any use of reference numbers in the attached claims is made exclusively for the purpose of facilitating the reading of the claims in the light of the above description and attached drawings, and shall not be deemed to restrict the scope of the invention in any way.

The invention claimed is:

1. A Yankee cylinder for drying webs of cellulose material, comprising:

a cylindrical shell with a substantially cylindrical outer surface, wherein end heads are fixed to said cylindrical shell by welding, said cylindrical shell and said end heads forming a hollow inside volume of the cylinder, the end heads having respective support journals, an insulation on each said end heads;

a connecting ring for connecting each said insulation to a respective end head such that said insulation is connected to the respective end head and rotates integrally with the Yankee cylinder, wherein each connecting ring surrounds the respective support journal and is arranged spaced from said respective support journal.

2. A Yankee cylinder according to claim 1, wherein each connecting ring is welded on an outer flat surface of the respective end head and projects from said outer flat surface.

3. A Yankee cylinder according to claim 2, wherein said insulation comprises a plurality of segments adjacent to each other, each of said segments being constrained to the respective connecting ring and to the respective support journal.

4. A Yankee cylinder according to claim 3, wherein each segment comprises an insulating sheet, said insulating sheet being fixed to the connecting ring by a screw means in a proximity of a radially outer edge thereof, and said insulating sheet being constrained by a radially internal edge thereof to the respective support journal.

5. A Yankee cylinder according to claim 4, wherein each journal comprises a continuous annular groove, said radially internal edge of the insulating sheets forming the insulation of the respective end head engaging said continuous annular groove.

6. A Yankee cylinder according to claim 5, wherein a depth of the continuous annular groove of said support journals is oversized with respect to a radial dimension of the insulating sheets, for allowing a thermal expansion of the end heads while maintaining a mechanical constraint between the insulating sheets and the support journals.

7. A Yankee cylinder according to claim 4, wherein the insulating sheets connected to a same end head are partially overlapped to each other along the radial edges.

8. A Yankee cylinder according to claim 1, wherein each connecting ring is fixed to the end head by welding.

9. A Yankee cylinder according to claim 8, wherein said insulation comprises a plurality of segments adjacent to each other, each of said segments being constrained to the respective connecting ring and to the respective support journal.

10. A Yankee cylinder according to claim 9, wherein each segment comprises an insulating sheet, said insulating sheet being fixed to the connecting ring by a screw means in a proximity of a radially outer edge thereof, and said insulating sheet being constrained by a radially internal edge thereof to the respective support journal.

11. A Yankee cylinder according to claim 10, wherein each journal comprises a continuous annular groove, said radially internal edge of the insulating sheets forming the insulation of the respective end head engaging said continuous annular groove.

12. A Yankee cylinder according to claim 11, wherein a depth of the continuous annular groove of said support journals is oversized with respect to a radial dimension of the insulating sheets, for allowing a thermal expansion of the end heads while maintaining a mechanical constraint between the insulating sheets and the support journals.

13. A Yankee cylinder according to claim 1, wherein said insulation comprises a plurality of segments adjacent to each other, each of said segments being constrained to the respective connecting ring and to the respective support journal.

14. A Yankee cylinder according to claim 13, wherein each segment comprises an insulating sheet, said insulating sheet being fixed to the connecting ring by a screw means in a proximity of a radially outer edge thereof, and said insulating sheet being constrained by a radially internal edge thereof to the respective support journal.

15. A Yankee cylinder according to claim 14, wherein each journal comprises a continuous annular groove, said radially internal edge of the insulating sheets forming the insulation of the respective end head said continuous annular groove.

16. A Yankee cylinder according to claim 15, wherein a depth of the continuous annular groove of said support journals is oversized with respect to a radial dimension of the insulating sheets, for allowing a thermal expansion of the end heads while maintaining a mechanical constraint between the insulating sheets and the support journals.

17. A Yankee cylinder according to claim 14, wherein the insulating sheets connected to a same end head are partially overlapped to each other along the radial edges.

18. A Yankee cylinder according to claim 1, wherein said connecting ring has a substantially cylindrical outer surface, constituting an extension of the substantially cylindrical outer surface of the shell.

19. A Yankee cylinder according to claim 18, wherein said connecting ring is welded to the respective end head by a substantially continuous annular welding bead and said substantially continuous annular welding bead is arranged at a radially outer edge of the end head.

20. A Yankee cylinder according to claim 19, wherein the substantially cylindrical outer surface of the shell, the radially outer surface of the end heads, the radially outer surface of the connecting rings and the annular welding bead between each connecting ring and the respective head have a common continuous surface treatment.

21. A Yankee cylinder according to claim 1, wherein said connecting ring is welded to the respective end head by a substantially continuous annular welding bead.

22. A Yankee cylinder according to claim 21, wherein said welding bead is made so as to surface on a radially outer surface of said connecting ring.

23. A Yankee cylinder according to claim 21, wherein said welding bead surfaces on a radially inner surface of said connecting ring.

24. A Yankee cylinder according to claim 21, wherein a substantially annular continuous slot is provided between said connecting ring and said end head on an inner side of said connecting ring.

25. A Yankee cylinder according to claim 24, wherein said substantially annular slot penetrates into a thickness of the respective end head in an axial direction and into a thickness of the respective connecting ring in a radial direction, underneath an axial end surface of the connecting ring forming a support to the insulation.

26. A Yankee cylinder according to claim 25, wherein said substantially annular slot has a depth into the thickness of the respective end head that increases radially outwardly, forming an inclined annular surface that extends from a substantially flat outer surface of the end head radially outwardly and axially inwards the thickness of the respective end head.

27. A Yankee cylinder according to claim 1, wherein said connecting ring has a cross section of variable thickness, minimum at an inside diameter and maximum at an outside diameter of the connecting ring, defining a hollow annular volume between the end head and the connecting ring.

28. A Yankee cylinder according to claim 1, wherein said connecting ring has a front outer surface, wherein a seat is formed whereon radially external edges of insulating sheets forming said insulation rest.

29. A Yankee cylinder according to claim 28, wherein said front outer surface is substantially orthogonal to an axis of the Yankee cylinder.

30. A Yankee cylinder according to claim 1, wherein said shell and said end heads are made of steel.

31. A Yankee cylinder according to claim 1, wherein said inner volume delimited by said shell and said end heads is designed and arranged to receive a heat carrier fluid therein, said heat carrier fluid yielding heat through said shell to a web guided around the Yankee cylinder, said heat carrier fluid being in direct contact with an inner surface of said shell.

* * * * *